US006745870B2

(12) United States Patent
Smith

(10) Patent No.: US 6,745,870 B2
(45) Date of Patent: Jun. 8, 2004

(54) ADJUSTABLE LADDER SUPPORT

(76) Inventor: William T. Smith, 2177 Seaman Cir., Chamblee, GA (US) 30341

( * ) Notice: Subject to any disclaimer, the term of this patent is extended or adjusted under 35 U.S.C. 154(b) by 0 days.

(21) Appl. No.: 10/277,917

(22) Filed: Oct. 23, 2002

(65) Prior Publication Data

US 2004/0079588 A1 Apr. 29, 2004

(51) Int. Cl.[7] ..... E06C 1/00

(52) U.S. Cl. ..... 182/201; 182/202; 182/203; 182/204; 182/205

(58) Field of Search ..... 182/200–205; 248/229.11, 227.3, 228.2, 231.31

(56) References Cited

U.S. PATENT DOCUMENTS 6,126,122 A * 10/2000 Ismert ..... 248/74.1

* cited by examiner

*Primary Examiner*—Alvin Chin-Shue
(74) *Attorney, Agent, or Firm*—Lacasse & Associates, LLC; Randy W. Lacasse; Jaclyn A. Schade

(57) ABSTRACT

A channel with sliding clamp and rod arrangement for leveling a ladder comprising a base unit of a hollow rectangular shape adapted to fit over the leg of the ladder. The base unit has interior walls spaced apart sufficiently to accommodate the ladder leg. Each of the walls has formed thereon a plurality of spaced splices that slop outwardly and downwardly away from the ladder leg. A clamp member comprises a generally rectangular block that has formed thereon sloping splices that fit into the grooves or spaces between the splices of the base unit. Clamp member has a bore that adjustably and securely retains a support rod, which has a swivel foot at one end. The end of the clamp member that is to be placed adjacent the ladder leg and the opposing interior surface of the base unit have a substantially V-shaped configuration to insure slip free purchase against the ladder leg.

13 Claims, 7 Drawing Sheets

ADJUSTABLE LADDER SUPPORT

BACKGROUND OF THE INVENTION

1. Field of Invention

The present invention relates generally to the field of ladder attachments. More specifically, the present invention is related to removable ladder attachments; to provide support for a ladder.

2. Discussion of Prior Art

Ladders are used extensively in a number of different situations such as construction, painting, building maintenance, etc. At times, the surface a ladder needs to be placed on is uneven or inclined. Yet, placement of a ladder on an uneven surface renders the ladder unstable, which increases the possibility of the ladder toppling over, resulting in injury to workers. Therefore, a number of devices have been developed to adjust the level of the ladder legs so that the ladder is firmly supported, even when placed on uneven surfaces.

U.S. Pat. No. 3,447,631 (Smith) describes a ladder level having an adapter unit and a length-adjusting unit. The adapter unit is capped over forward edge portion,of the ladder leg, while the length adjusting unit is capped over the rear edge portion of the ladder leg. The web of the adjusting unit has teeth on the exterior portion, which cooperate with a latch dog connected to the adjusting unit to provide for sliding and locking the length adjustment member.

U.S. Pat. No. 4,412,599 (McCrudden et al.) describes a ladder leg extender in which an extension piece is loosely fitted within a rectangular opening defined by the ladder leg and flanges of an attachment piece. Tightening of a handle bolt biases the ladder leg towards the flanges to secure the extension piece therein.

U.S. Pat. No. 4,607,726 (Davis et al.) describes a ladder leveler that includes an outer sleeve member and an extension member. At the lower end of the extension member is foot that provides a gripping action to prevent slipping. Two L-shaped brackets are mounted to the sleeve member to receive and support a ladder leg. Opposing lockscrews advance through threaded bores or locknuts in the L-shaped brackets to engage the ladder leg on opposing sides so that the ladder leveler is secured to the ladder.

U.S. Pat. No. 4,792,017 (Grove) describes an adjustable support for ladders that includes load-supporting units that are axially-aligned with bearing members on ladder. The bearing members are connected within channel-like legs of the ladder. The bearing members have axially-aligned holes to receive elongated, externally threaded members, which can be secured in different vertical positions to provide adjustability.

U.S. Pat. No. 5,551,529 (Molitor) describes a ladder stabilizer comprising main frames, legs configured to slidingly engage with the main frames, and feet attached to:legs. Each main frame has a L-shaped pin that extends through a horizontally extending hole in the main frame and another hole in leg to lock the leg to the main frame at a desired height.

U.S. Pat. No. 5,678,656 (Lanzafame) describes a ladder stabilizing and leveling device with an outer housing fixed to a ladder rail and an inner housing, movable within the outer housing. The inner housing is locked in place by a lock block attached thereto that rotates so that its lock tip engages lock nubs attached to the outer housing. The lock tip engages the lock nubs such that a greater force is applied between the locking tip and locking nub when greater downward force is applied to the ladder rail so as to ensure the inner housing does not move.

There is still a desire, however, for an adjustable ladder support that is easily and removably attached without the need for any tools, and that employs an attachment arrangement that acts to tighten the grip on the ladder leg during use, thereby insuring against slippage.

SUMMARY OF THE INVENTION

Generally, a ladder attachment that can be removably secured to a ladder leg is provided. The ladder attachment comprises a base unit and a clamping member. The base unit has a channel formed by a web and corresponding sidewalls substantially perpendicular to the web. The sidewalls are sufficiently spaced apart to accommodate the ladder leg and the interior surface of each sidewall has sloping splices formed thereon. The clamping member is generally rectangular and has sloping splices formed on its first and second side surfaces. The sloping splices on the clamping member are dimensioned and arranged so as to slidably engage with the sloping splices on the sidewalls. The clamping member also has a bore to adjustably and securely retain a support rod therein. The sloping splices on the clamping member and the sloping splices on the sidewalls are arranged such that, during use, the clamping member is biased towards the ladder leg.

DETAILED DESCRIPTION

Figure 1:
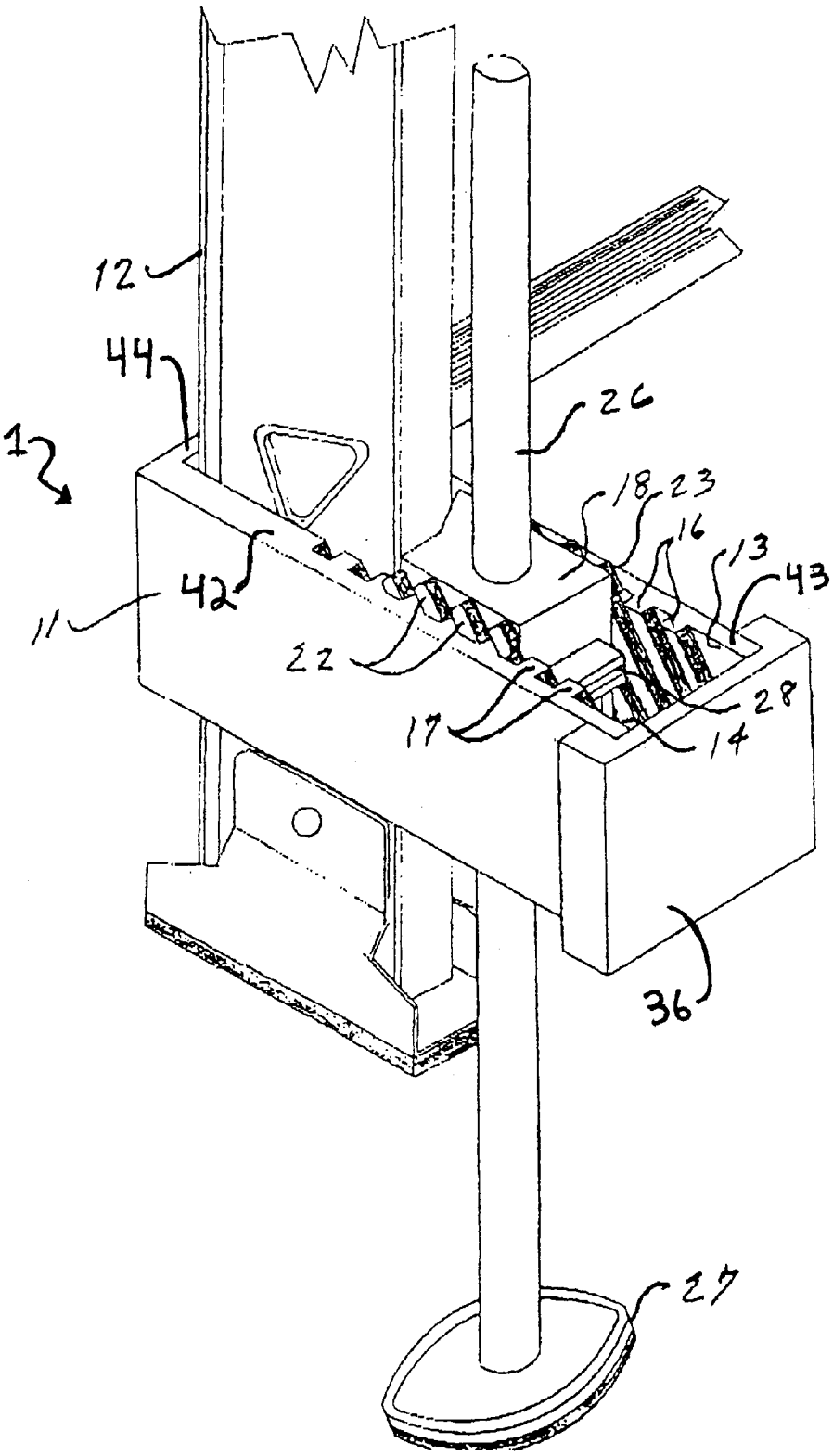
FIG. 1 illustrates an assembled ladder attachment according to the present invention.

It will be understood that the device of the present invention may be produced in many different configurations, forms and materials. The present invention is depicted in the drawings, and will herein be described in detail, with the understanding that the present disclosure is to be considered as an exemplification of the principles of the invention and the associated functional specifications for its construction and is not intended to limit the invention to what is illustrated.

It is envisioned that the ladder attachment of the present invention is used primarily as a ladder leveler. Other uses, however, are possible. For instance, it may also be used at the top of the ladder in an upside down position for holding ladder stand-offs. Various other variations will also occur to workers in the art without departure from the scope of the invention.

Referring to FIGS. 1–4, the ladder attachment 1 of the present invention generally comprises a base unit that has a channel 11 formed by web 44 and corresponding sidewalls 42 and 43 substantially perpendicular thereto. The base unit also has a removable end cap 36 that attaches to the ends of sidewalls 42 and 43 opposite web 44, as described further below. Channel 11 is made of metal, high strength plastic, wood, or other suitable material. Sidewalls 42 and 43 are sufficiently spaced apart to accommodate the ladder leg 12. The interior surfaces 14 and 13 of each sidewall 42 and 43, respectively, has formed thereon a plurality of spaced splices 16 and 17, which slope away from web 44 in a direction downward from the top of channel 11.

Figure 2:
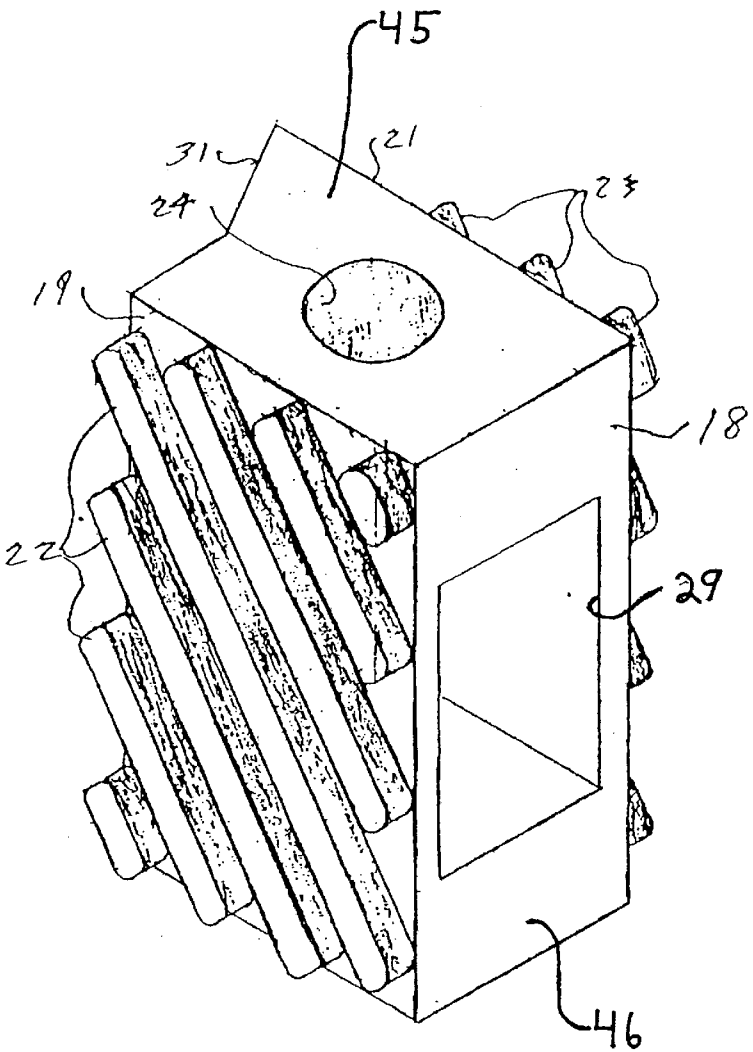
FIG. 2 illustrates an embodiment of a clamp member of the ladder attachment according to the present invention.

A clamp member 18, as best seen in FIG. 2, comprises a generally rectangular block of metal, high strength plastic, wood, or other suitable material. First and second side surfaces 19 and 21 of clamp member 18 also have formed thereon sloping slices 22 and 23. The width and height of each of the splices 22 and 23, and the spacing between them, is such that they fit into the grooves or spaces between the splices 16 and 17 on channel 11.

Clamp member 18 has a bore 24 extending therethrough from top surface 45 for receiving a support rod 26, which has a swivel foot 27 at one end. Support rod 26 is held in place within clamp member 18 by a suitable clamping means 28, which may take any of a number of forms. Clamping means 28, which may take the form of wedges, for example, must be capable of holding rod 26 firmly in place within member 18 without slippage. Other types of clamping means known in the art may also be used. The clamping means 28 may fit within a bore 29 in first end 46, or it may take the form of a bolt number (not shown) that is screwed into member 18. The second end 31 of member 18 that is to be placed adjacent ladder leg 12, as shown in FIG. 1, has a substantially V-shaped configuration to insure slip free purchase against ladder leg 12 by bearing against the leg and at least one edge of a leg rail or flange, as shown. The interior surface 32 of web 44 has a similar, substantially V-shaped configuration, as shown in FIG. 3 that also insures slip-free purchase of channel 11 against ladder leg 12.

Figure 3:
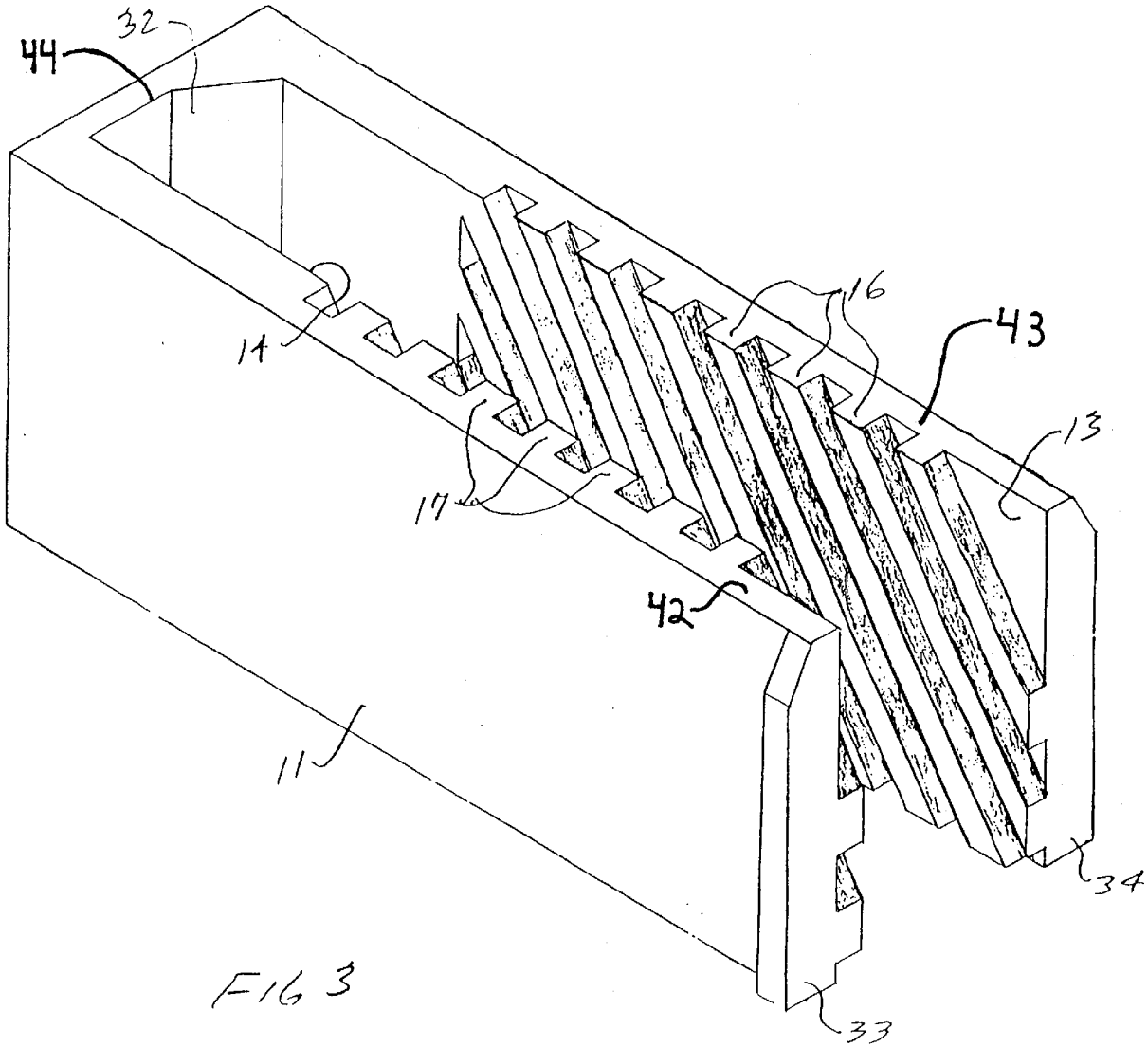
FIG. 3 illustrates the channel of an embodiment of the ladder attachment's base unit.
Figure 4:
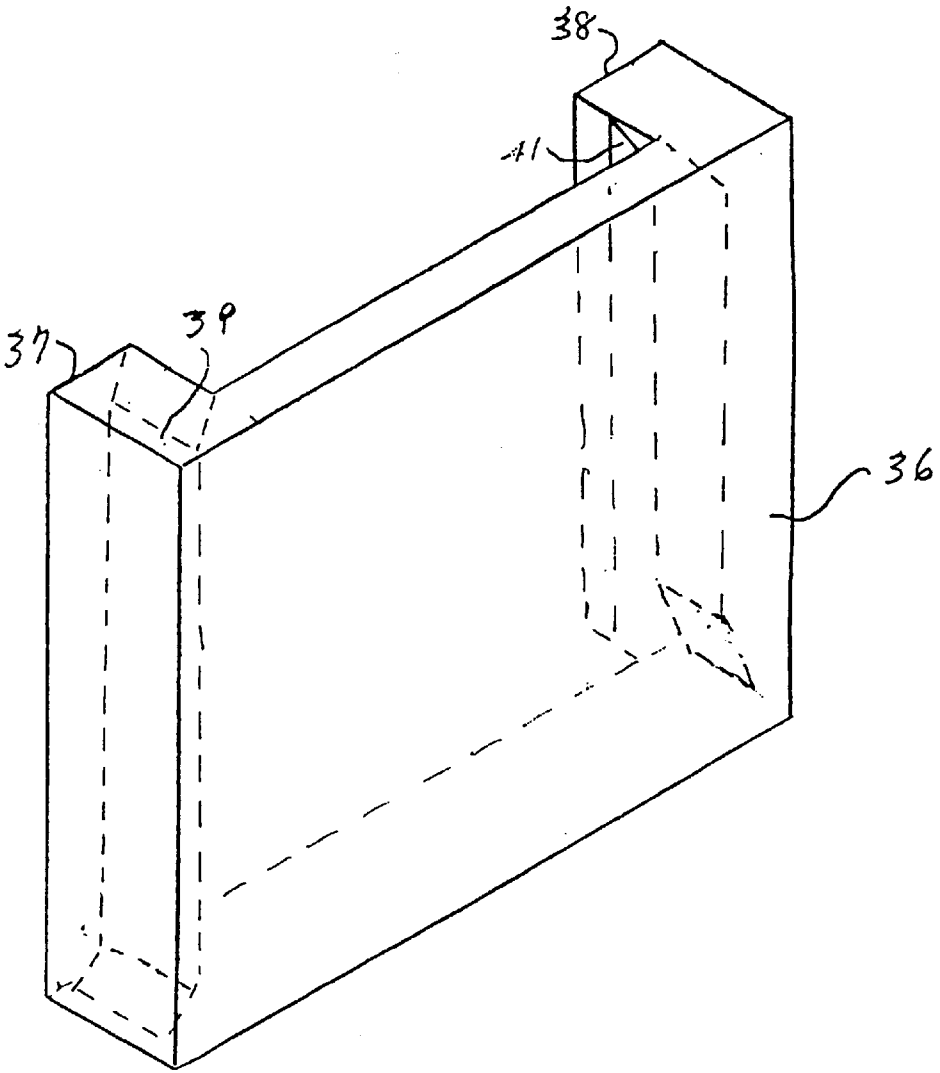
FIG. 4 illustrates the end cap of an embodiment of the ladder attachment's base unit.

Also as shown in FIG. 3, the open end of channel 11 has first and second outwardly extending flanges 33 and 34 for receiving an end cap 36, shown in FIG. 4. End cap 36 has first and second flanges 37 and 38 that have slots 39 and 41, the ends of which are tapered as shown in the clashed lines, for gripping the flanges 33 and 34 of channel 11.

In use, the forces on the ladder and the adjustable support act to tighten the grip of channel 11 and clamp member 18 on ladder leg 12, thereby insuring against slippage. Clamp member 18 experiences an upward force from rod 26, while channel 11 experiences a downward force from ladder leg 12. This tends to cause clamp member 18 to move slightly upward relative to channel 11. Because of the sloping splices, clamp member 18 is biased towards ladder leg 12 when it moves upward. Therefore, the slight upward movement caused by the forces act to bias clamp member towards ladder leg 12, thereby tightening the grip of channel 11 and clamp member 18 on ladder leg 12.

Figure 5:
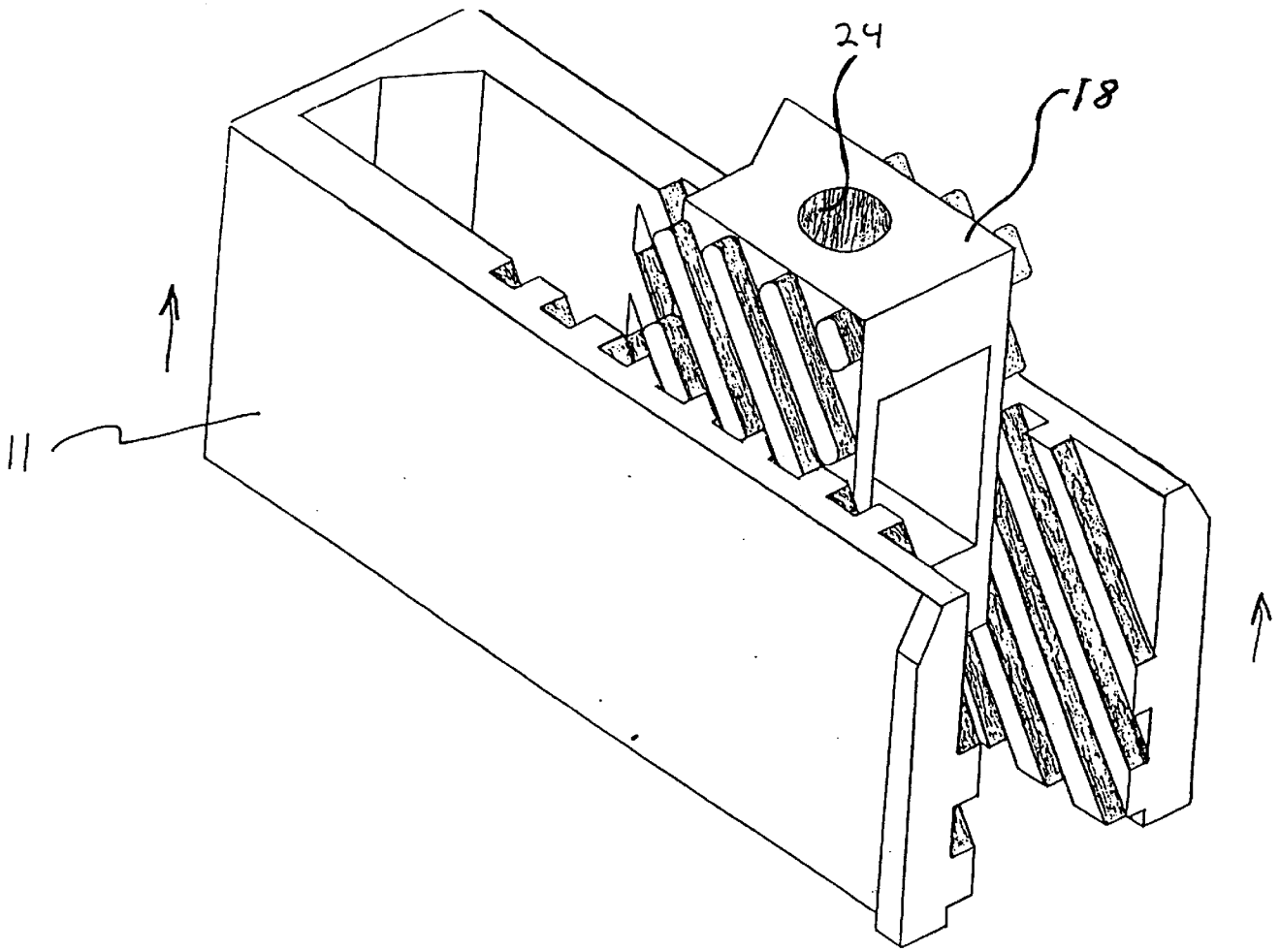
FIGS. 5, 6, and 7 illustrate the assembly procedure for an embodiment of the ladder attachment according to the present invention.
Figure 6:
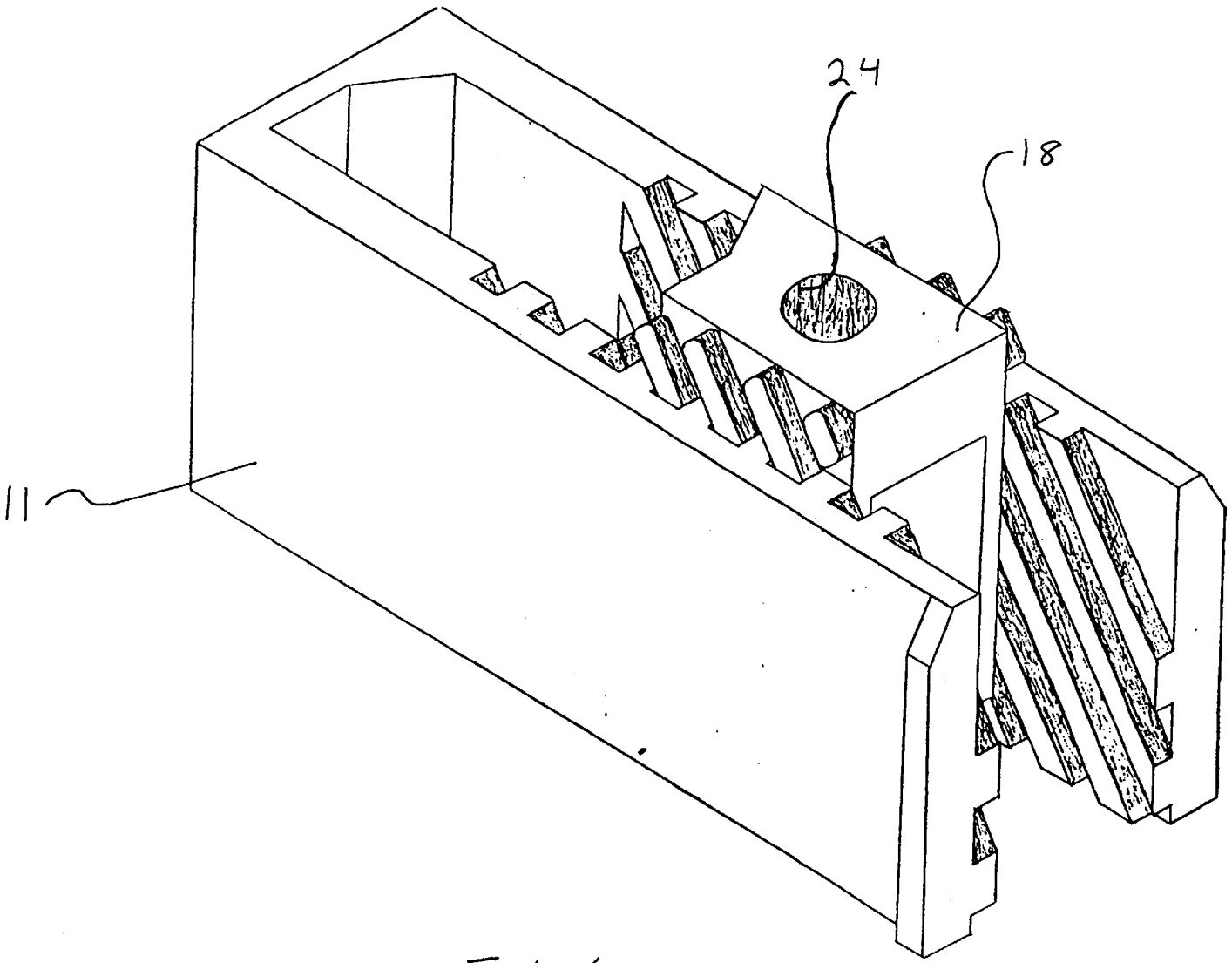
Figure 7:
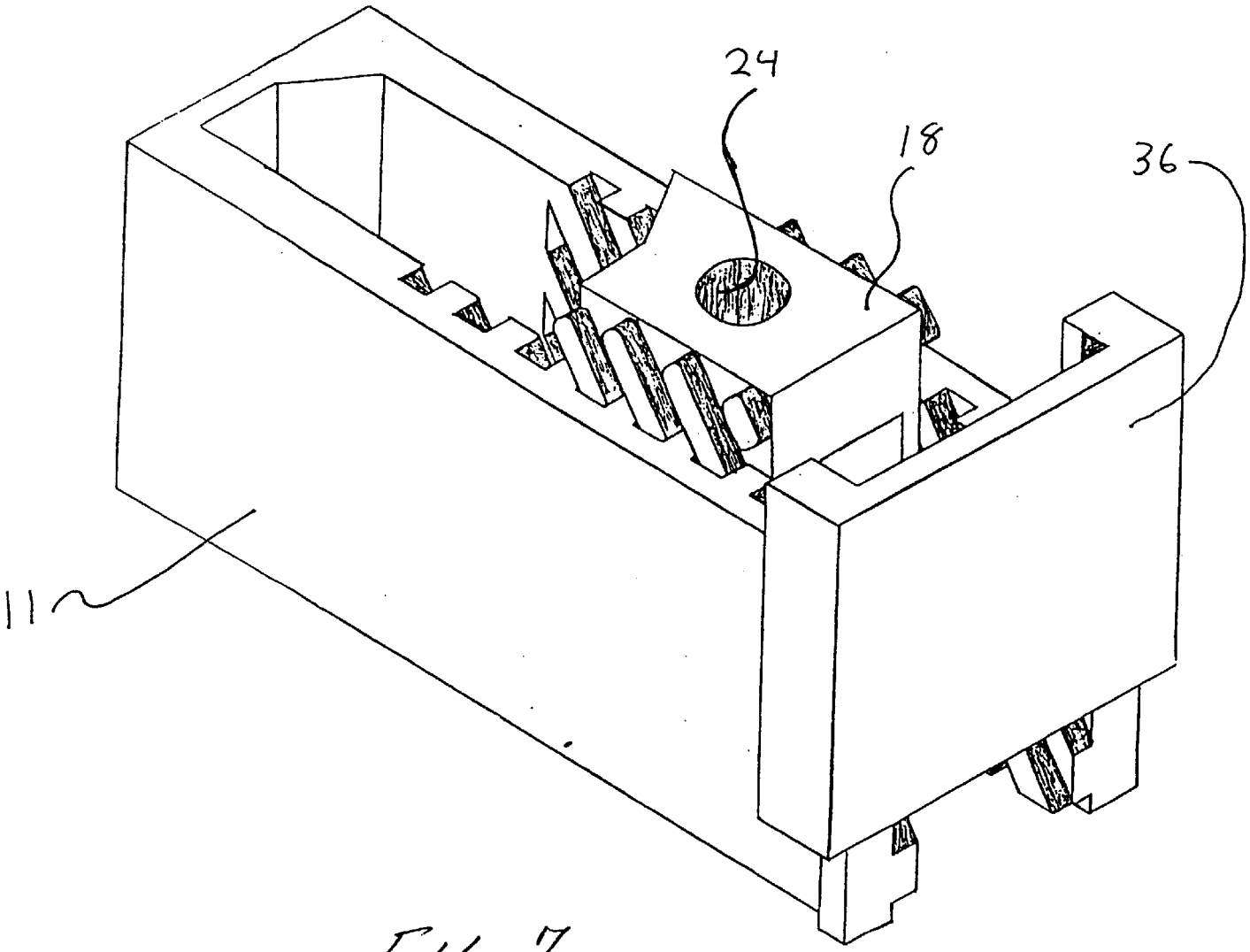

FIGS. 5, 6, and 7 illustrate the assembly procedure for the ladder attachment 1 of the present invention without the ladder leg 12 and support rod 26 being shown. The channel 11 is placed on ladder leg 12, and the sliding clamp member 18 is then positioned at the desired location, preferably just below a ladder rung. The channel 11 is then slid upward onto the clamp member 18, with their respective splices and grooves meshing, until both members grip the ladder leg tightly. Support rod 26 is then adjusted in bore 24 to produce the desired ladder leg extension and locked in place. End cap 36 is then mounted. Thus, as can be seen, no tools of any sort are required to assemble and use the adjustable ladder support according to the invention.

The foregoing is considered illustrative only of the principles of the invention. Therefore, it will be understood that there is no intent to limit the invention by such disclosure, but rather, it is intended to cover all modifications and alternate constructions falling within the spirit and scope of the invention. For example, while a removable end cap 36 has been illustrated, the present invention is not limited thereto. Rather, an integral end cap, or no end cap, can be used. As another alternative, a nut and bolt arrangement, or other screw-type mechanism, can be used in place of the end cap to provide an adjustable, substantially inward compressive force on sidewalls 42 and 43.

What is claimed is:

1. A ladder attachment that can be removably secured to a ladder leg to provide leveling comprising:

a base unit having:

a channel formed by a web and corresponding sidewalls substantially perpendicular to the web, the sidewalls sufficiently spaced apart to accommodate the ladder leg, the interior surface of each sidewall having sloping splices formed thereon; a generally rectangular clamping member having:

sloping splices formed on first and second side surfaces of the clamping member, the sloping splices on the clamping member dimensioned and arranged so as to slidably engage with the sloping splices on the sidewalls; and a bore adjustably and securely retaining a support rod therein;

said sloping splices on the clamping member and the sloping splices on the sidewalls are arranged such that, during use, the clamping member is biased towards said channel to clamp the ladder leg; and wherein said ladder attachment enables leveling of said ladder by selective engagement of said sloping splices of said clamping member with said channel sidewalls at a specific point on said ladder leg.

2. A ladder attachment that can be removably secured to a ladder leg, as per claim 1, wherein the bore extends through the clamping member from the top surface thereof.

3. A ladder attachment that can be removably secured to a ladder leg, as per claim 1, wherein the support rod has a swivel foot attached at one end.

4. A ladder attachment that can be removably secured to a ladder leg, as per claim 1, wherein the splices on the sidewalls slope away from the web in a downward direction from the top of the channel and the splices on the side surfaces of the clamping member slope in substantially the same direction as the splices on the sidewalls.

5. A ladder attachment that can be removably secured to a ladder leg, as per claim 1, the base unit further comprising:

an end cap attached to the ends of the sidewalls opposite the web.

6. A ladder attachment that can be removably secured to a ladder leg, as per claim 1, wherein the interior surface of the web has a substantially V-shaped configuration.

7. A ladder attachment that can be removably secured to a ladder leg, as per claim 1, wherein an end of the clamping member has a substantially V-shaped configuration.

8. A removable ladder leveler that can be removably attached to a ladder leg comprising:

a base unit having:

a channel formed by a web and corresponding sidewalls substantially perpendicular to the web, the interior surface of each sidewall having sloping splices formed thereon, the splices sloping away from the web in a downward direction from the top of the channel;

a generally rectangular clamping member having:

sloping splices formed on first and second side surfaces of the clamping member, the splices sloping in substantially the same direction as the splices on the sidewalls and dimensioned so as to slidably engage with the splices on the sidewalls;

a bore extending through the clamping member from the top surface thereof; and a support rod adjustably and securely retained in said bore, the support rod having a foot attached at one end for contacting an external surface; and wherein, during use, the splices on the clamping member and the splices on the interior surface of the sidewalls are arranged to bias the clamping member towards the ladder leg.

9. A removable ladder leveler that can be removably attached to a ladder leg, as per claim 8, wherein the foot is a swivel foot.

10. A removable ladder leveler that can be removably attached to a ladder leg, as per claim 8, the base unit further comprising:

an end cap attached to the ends of the sidewalls opposite the web.

11. A removable ladder leveler that can be removably attached to a ladder leg, as per claim 8, wherein the interior surface of the web has a substantially V-shaped configuration.

12. A removable ladder leveler that can be removably attached to a ladder leg, as per claim 8, wherein an end of the clamping member has a substantially V-shaped configuration.

13. A removable ladder leveler that can be removably attached to a ladder leg, as per claim 8, wherein said ladder attachment enables leveling of said ladder by selective engagement of said sloping splices of said clamping member with said channel sidewalls at a specific point on said ladder leg.

* * * * *

UNITED STATES PATENT AND TRADEMARK OFFICE

CERTIFICATE OF CORRECTION

PATENT NO. : 6,745,870 B2
DATED : June 8, 2004
INVENTOR(S) : Smith, William T.

It is certified that error appears in the above-identified patent and that said Letters Patent is hereby corrected as shown below:

Title page,
Item [56], References Cited, U.S. PATENT DOCUMENTS, include the following:

| | | | |
|---|---|---|---|
| -- 3,447,631 | 06/1969 | Smith | 182/108 |
| 4,412,599 | 11/1983 | McCrudden et al. | 182/201 |
| 4,607,726 | 08/1986 | Davis et al. | 182/204 |
| 4,792,017 | 12/1988 | Grove | 182/204 |
| 5,551,529 A | 09/1996 | Molitor | 182/204 |
| 5,678,656 A | 10/1997 | Lanzafame | 521/166 --. |

Signed and Sealed this

Twenty-eighth Day of March, 2006

JON W. DUDAS
*Director of the United States Patent and Trademark Office*